United States Patent [19]

Lee

[11] Patent Number: 4,726,119

[45] Date of Patent: Feb. 23, 1988

[54] CAN OPENER

[76] Inventor: Wen-Hsin Lee, 4th Fl., No. 61, Liu-Ho I Road, Kaohsiung City, Taiwan

[21] Appl. No.: 874,047

[22] Filed: Jun. 12, 1986

[51] Int. Cl.[4] ..... B67B 7/32

[52] U.S. Cl. ..... 30/418; 30/410

[58] Field of Search ..... 30/410, 418, 408, 443

[56] References Cited

U.S. PATENT DOCUMENTS 2,614,320 10/1952 Rosenberry ..... 30/418

4,327,490 5/1982 Hoskins ..... 30/410

FOREIGN PATENT DOCUMENTS 1217485 12/1970 United Kingdom ..... 30/410

*Primary Examiner*—Paul A. Bell

*Assistant Examiner*—Willmon Fridie, Jr.

*Attorney, Agent, or Firm*—Arnold, White & Durkee

[57] ABSTRACT

A can opener includes an operating rotary handle body incorporating a rotary serrated clamping head to clamp a projecting edge joint of a can against a cutting disc. The clamping head is mounted on an eccentric shaft which is driven by a central shaft of the handle body through gears in which the driven gear incorporates a means for moving axially the clamping head to a clamping position. Upon rotation of the handle body, the clamping head clamps a projecting edge joint of a can against the cutting disc, and the cutting disc severs the edge joint.

4 Claims, 8 Drawing Figures

CAN OPENER

BACKGROUND OF THE INVENTION

This invention relates to a can opener, and particularly to a can opener which includes an operating rotary handle body having a clamping means that clamps a projecting edge joint of a can against a disc cutter which cuts a can along a peripheral path adjacent to the projecting edge joint.

A conventional can opener includes a lever handle integrating a cutter at the end thereof to make a circumferential cut on a sealed cover of a can adjacent to a projecting edge joint formed between the sealed cover and a cylindrical wall of the can. A disadvantage of such a can opener is that the cutter contaminates the contents of the can as it penetrates into the interior of the can to a substantial distance during the cutting operation. Another disadvantage is that a substantial force is required to sever the cover from the body of the can.

Can openers which alleviate the disadvantages of the above can opener are disclosed in U.S. Pat. Nos. 1,825,216, 1,842,047 and 2,628,422. These can openers sever the projecting edge joint of a can, and, in common, have two pivoted handles incorporating a cutting disc and a feed roller or a clamping roller which clamps the projecting edge joint of the can against the cutting disc, and an operating lever used to rotate the feed roller and the cutting disc so as to produce a peripheral cut on the cylindrical wall of the can adjacent to the projecting edge joint. Such devices are also found to be unsatisfactory since they must be operated with two hands, one for operating the handles and the other for operating the lever.

SUMMARY OF THE INVENTION

An object of the invention is to provide an improved and simplified can opener which can be operated with only one hand and which can overcome the above-described disadvantages.

The present invention provides a can opener which comprises a handle body having a central shaft and an end face perpendicular to the central shaft, a clamping member having an eccentric shaft mounted movably in the handle body and having a serrated rotary clamping head mounted on the eccentric shaft and projecting from the clamping face, a driving gear mounted on the central shaft, a driven gear mounted on the eccentric shaft and comprising a cam for moving the eccentric shaft axially so as to place the clamping head between a first position in which the clamping head approaches the end face and a second position in which said clamping head moves away from said end face of said handle body, a cutting disc mounted in said handle body and having a cutting blade against which the projecting edge joint of the can is clamped by said clamping head, the cutting blade being protruded from the clamping face of the handle body, and a fixed latch projecting from the end face adapted to abut with the sealed cover of a can so that the can opener can be held rigidly against the can.

In another aspect of the invention, the driven gear means includes a hollow body having a substantially cylindrical wall, an annular end wall intersecting said cylindrical wall, and an outer annular flange with gear teeth at the periphery of said cylindrical wall. The inner side of the cylindrical wall has two axially extending and inwardly projecting protrusions disposed at diametrically opposite positions. The cam is formed on the inner side of said end wall and comprises two camming surfaces which extend along an arc of the end wall between said two protrusions, and which are slanted such that a portion thereof adjacent to one protrusion extends axially inward to a smallest extent, and another portion adjacent to another protrusion extends axially inward to a greatest extent. A cam follower transverse pin is attached to the eccentric shaft in contact with the camming faces so that, when rotating the handle body, the camming surfaces will cam the transverse pin to move the clamping head to a clamping position.

The present exemplary preferred embodiment will be described in detail with reference to the following drawings, in which:

DETAILED DESCRIPTION OF THE PREFERRED EMBODIMENT

Figure 1:
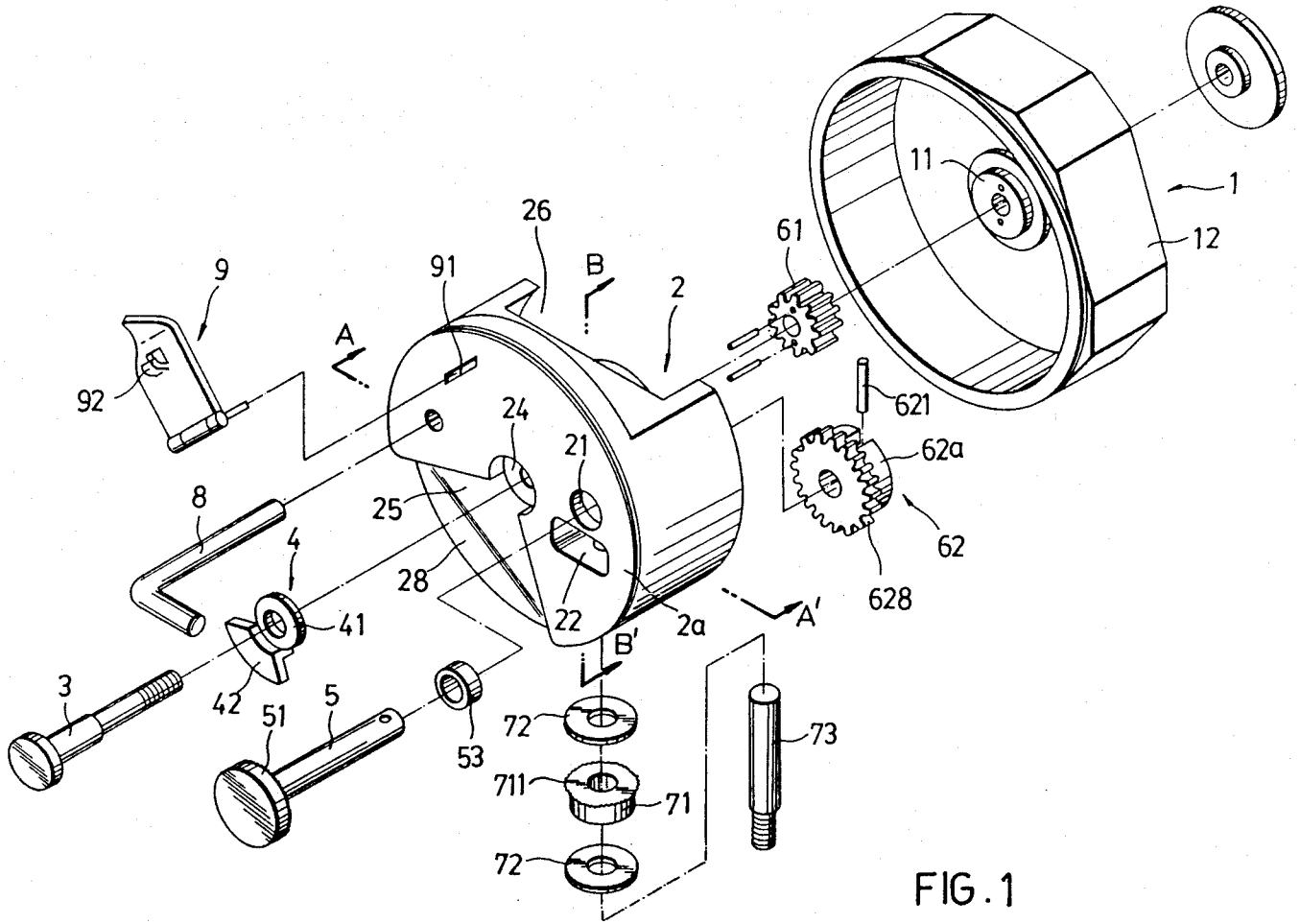
FIG. 1 is an exploded view of a can opener according to the present invention.

Referring to the drawings, a preferred embodiment of a can opener is shown, including a handle body 1 constituted of a casing 12 and a core body 2. The casing 1 is substantially cylindrical and has a central circular boss 11. The core body 2 is fixed to the casing 1 by means of a central headed and threaded shaft 3 which passes through the core body 2 and is threaded into the boss 11 of the casing 1. Adjacent to the headed end of the shaft 3 is mounted a collar member 4 which has an annular portion 41 received in a circular recess 24 of the core body 2 and a sector-shaped flanged portion 42 projecting into a cavity 25 of the core body 2 to be used as a bottle opener.

Figure 2A:
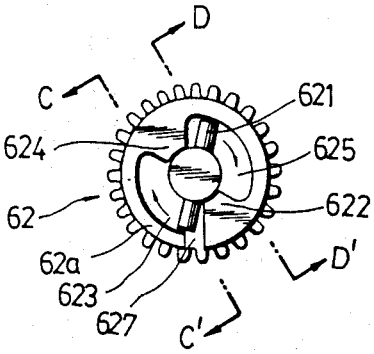
FIG. 2A is a plan view of a driven gear of the clamping member.
Figure 2B:
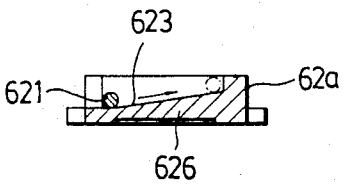
FIG. 2B is a sectional view taken along line C—C′ of FIG. 2A.
Figure 2C:
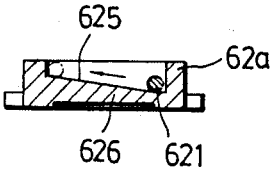
FIG. 2C is a sectional view taken along line D—D′ of FIG. 2A.
Figure 3:
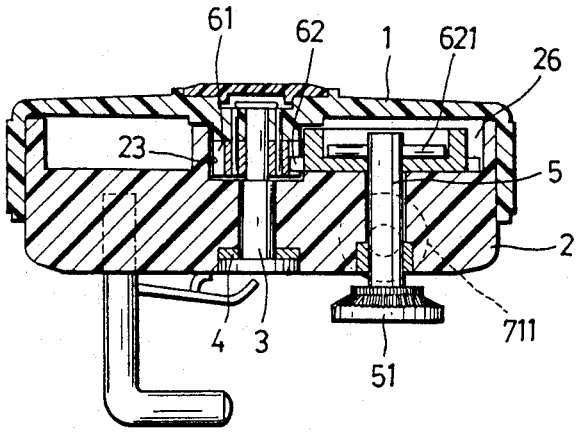
FIG. 3 is a sectional view taken along line A—A′ of FIG. 1.

A gear 61 is sleeved onto the shaft 3 and received in a recess 23 of the core body 2 into which a portion of the boss 11 projects. The recess 23 is communicated with an annular recess 26 of the core body 2 which receives a driven gear 62. The driven gear 62 is movably mounted on an eccentric shaft 5 which passes through a hole 21 of the core body 2, and has a hollow cylindrical wall **62*a* with a toothed flange 628 which is meshed with the driving gear 61. As better shown in FIGS. 2A, 2B and 2C, the inner side of the cylindrical wall 62*a* has two axially extending and inwardly projecting protrusions 622 and 624 disposed at diametrically opposing positions. An annular end wall 626 intersects the hollow cylindrical wall 62*a* and is sleeved movably on the shaft 5. The inner side of the end wall 626 defines two camming surfaces 623 and 625 each of which extends along an arc of the end wall 626 between the two protrusions 622 and 624. The camming surface 625 is slanted such that a portion thereof adjacent to the protrusion 622 extends axially inward to a greatest extent and another portion adjacent to the protrusion 624 extends axially inward to a smallest extent. The camming surface 623 is slanted such that a portion thereof adjacent to the protrusion 624 extends axially inward to a greatest extent, and another portion adjacent to the protrusion 622 extends axially inward to a smallest extent. An opening 627 is provided in the cylindrical wall 62***a* of the driven gear 62.

A cam follower pin 621 is attached transversely to the shaft 5 and is in contact with the slanted cam surfaces 623 and 625. At the outer end of the shaft 5 which projects outwardly of the core body 2 is a serrated rotary clamping head 51. A sleeve member 53 is attached to the shaft 5 near the clamping head 51. When rotating the handle body 1, the transverse pin 621 is cammed by the cam surfaces 623 and 625 of the gear 62 so that the shaft 5 can be moved axially inward and outward and the clamping head 51 can be moved toward and away from the clamping face 2*a*. When the pin 621 engages with the protrusions 622 and 624, the clamping head will be rotated.

Fitted in a cavity 22 of the core body 2 opening at the end face 2*a* is a cutting disc 71. The cutting disc 71 is mounted on a rod 73 which in turn is inserted fixedly in the core body 2 at a position normal to the shaft 5. Two packing members 72 are attached to the rod 73 to frictionally hold the cutting disc 71 in position. The cutting member 71 has a curved cutting blade 711 which protrudes from the end face 2*a* of the core body 2. An angled latch 8 is fixed to the core body 2, projecting from the end face 2*a* to a substantial distance, to be used to abut with a sealed cover of a can so that the can opener can be held rigidly against the can.

Figure 4:
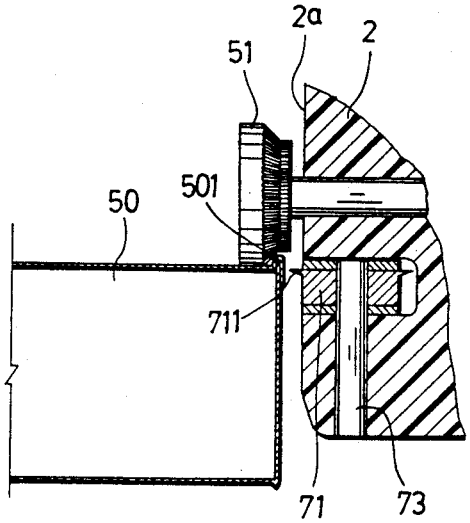
FIG. 4 is a fragmentary sectional view of the can opener taken along line B—B′ of FIG. 1 with a portion of a can.
Figure 5:
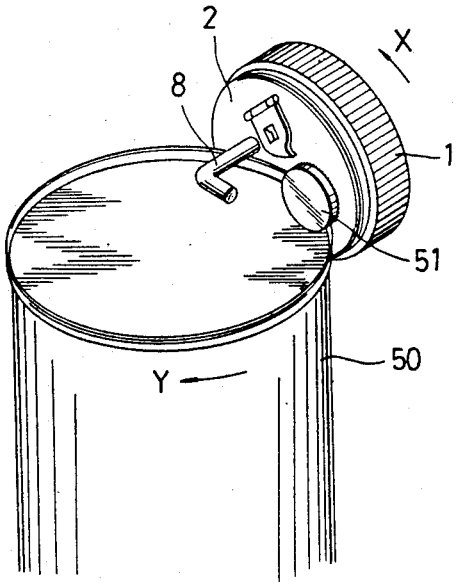
FIG. 5 is a perspective view showing the operating situation of the can opener.

FIGS. 4 and 5 illustrate how the can opener is operated to open a can 50, in which a projecting edge joint of the can is placed between the rotary clamping head 51 and the end face 2*a* of the body 2. When the handle body 1 is rotated in a direction indicated by X, the clamping head 51 clamps tightly the projecting edge joint 501 of the can against the cutting blade 711 of the cutting disc 71, and the cutting blade 711 penetrates the peripheral wall of the can. The latch 8 is caused to press against the top sealed cover of the can, thereby holding the can opener in a firm and stable position relative to the can 50. When the handle body 1 is rotated in a direction indicated by Y, the clamping head 51 is rotated along the projecting edge joint, and the cutting blade 711 moves and makes a peripheral cut adjacent to the projecting edge joint.

Figure 6:
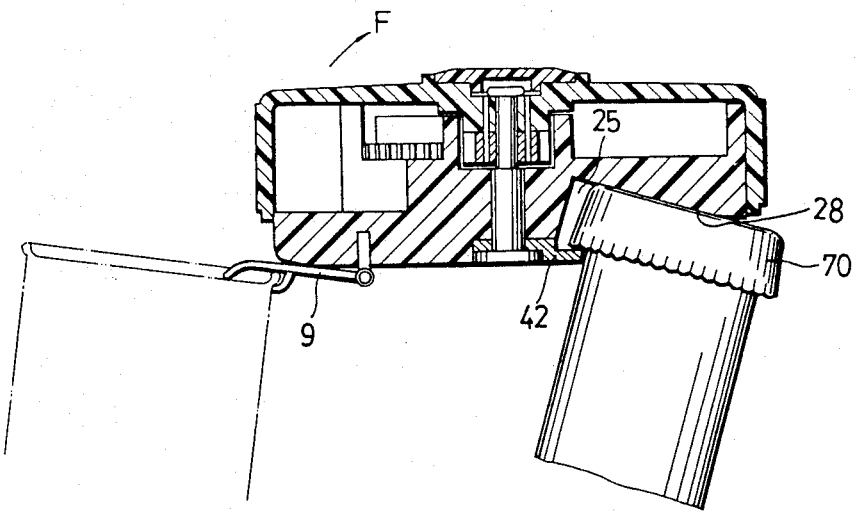
FIG. 6 shows how the can opener is used to open a bottle.

FIG. 6 illustrates how the flange 42 of the can opener is used to open a capped bottle, wherein the flange 42 is caused to clamp the cap 70 of the bottle against an engaging surface 28 of the core body 2. When the handle body 1 is moved in a direction indicated by F, the cap 70 will be removed from the bottle top.

In order to diversify the application of the can opener, a cap opener 9 is also attached to the core body 2 at a location indicated by 91. The cap opener 9 is a plate member which is punched to have a louver 92. The plate member is pivoted to the core body 2, and when in use, it is placed in a position as shown in FIG. 6.

It can be appreciated that the current can opener is more advantageous than those disclosed in the above described U.S. patents because the current construction is simple and can be operated in a simple manner just by rotating the handle body 1.

With the invention thus explained, it is apparent that various modifications and variations can be made without departing from the scope of the invention. It is therefore intended that the invention be limited as indicated in the appended claims.

What I claim is:

1. A can opener for cutting a can having a peripheral projecting edge joint between a sealed cover and a cylindrical wall, comprising:

a handle body having a central shaft and a end face perpendicular to said central shaft;

a clamping member having an eccentric shaft mounted movably in said handle body and having a serrated rotary clamping head mounted on said eccentric shaft and projecting from said end face;

a driving gear mounted on said central shaft;

a driven gear mounted on said eccentric shaft and meshed with said driving gear, said driven gear comprising a cam for moving axially said eccentric shaft upon rotation of said handle body so as to move said clamping head toward said end face;

a cutting dish mounted in said handle body and having a cutting blade, against which the projecting edge joint of the can is clamped by said clamping head, protruding from said end face of said handle body; and a latch member projecting from said end face.

2. A can opener as claimed in claim 1, wherein said driven gear includes a hollow body having a substantially cylindrical wall, an annular end wall intersecting said cylindrical wall, and an outer annular flange with gear teeth at the periphery of said cylindrical wall, the inner side of said cylindrical wall having two axially extending and inwardly projecting protrusions disposed at diametrically opposite positions, said cam being formed on the inner side of said end wall and comprising two camming surfaces which extend along an arc of said end wall between said protrusions, each of said camming surfaces being slanted such that a portion of said camming surface adjacent to one of said protrusions extends axially inward to a smallest extent, and another portion of said camming surface adjacent to another one of said protrusions extends axially inward to a greatest extent, said eccentric shaft having a transverse cam follower pin attached thereto in contact with said camming surfaces.

3. A can opener as claimed in claim 2, wherein said handle body further includes a recess adjacent to and open at said end face, and said central shaft further includes a collar member attached thereto near said end face, said collar member having a flange extending radially into said recess to be used as a bottle opener.

4. A can opener as claimed in claim 2, further including a plate member pivoted to said handle body, said plate member having a punched louver formed thereon to be used as a bottle cap opener.

* * * * *